US009682306B2

(12) United States Patent
Lin et al.

(10) Patent No.: US 9,682,306 B2
(45) Date of Patent: Jun. 20, 2017

(54) EXERCISE BIKE AND OPERATION METHOD THEREOF

(71) Applicant: Industrial Technology Research Institute, Hsinchu (TW)

(72) Inventors: Li-Zen Lin, Hsinchu (TW); Hsueh-Lin Chen, Hsinchu (TW); Shu-Yuan Chang, Tainan (TW); Jong-Shyan Wang, Taoyuan County (TW); Tung-Hung Lu, Yilan County (TW); Yueh-Hsuan Lee, Hsinchu County (TW); Rong-Rong Chen, Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 813 days.

(21) Appl. No.: 13/735,044

(22) Filed: Jan. 7, 2013

(65) Prior Publication Data

US 2014/0113768 A1 Apr. 24, 2014

(30) Foreign Application Priority Data

Oct. 19, 2012 (TW) ..... 101138716 A

(51) Int. Cl.
*A63B 21/005* (2006.01)
*A63B 71/06* (2006.01)
(Continued)

(52) U.S. Cl.
CPC ..... *A63B 71/0619* (2013.01); *A63B 22/0605* (2013.01); *A63B 21/225* (2013.01);
(Continued)

(58) Field of Classification Search
CPC ..... A63B 24/0062; A63B 24/0087; A63B 2024/0065; A63B 2024/0068; A63B 2024/0093
(Continued)

(56) References Cited

U.S. PATENT DOCUMENTS 4,378,111 A 3/1983 Tsuchida et al.
5,067,710 A 11/1991 Watterson et al.
(Continued)

FOREIGN PATENT DOCUMENTS

CN 102407003 4/2012
JP 4249173 4/2009
(Continued)

OTHER PUBLICATIONS

Ruiter et al., "A Variable Resistance Virtual Exercise Platform for Physiotherapy Rehabilitation", 15th International Conference on Mechatronics and Machine Vision in Practice, Dec. 2008, p. 533-p. 538.

(Continued)

*Primary Examiner* — Joshua Lee
*Assistant Examiner* — Gregory Winter
(74) *Attorney, Agent, or Firm* — Jianq Chyun IP Office

(57) ABSTRACT

An exercise bike and an operation method thereof are provided. In a test mode, a processing unit adjusts a resistance of a pedaling activity to be a plurality of pedaling resistances and obtains a plurality of psychological values respectively corresponding to the pedaling resistances by inquiring the user about a rate of perceived exertion. The processing unit calculates the psychological values to obtain a plurality of exercise intensities respectively corresponding to the pedaling resistances and further obtain a correspondence relationship between the exercise intensities and the pedaling resistances. After the test mode ends, the process-
(Continued)

ing unit determines a recommended pedaling resistance according to the correspondence relationship. In a sport mode, the recommended pedaling resistance is provided to the user for performing the pedaling activity. The exercise bike determines the recommended pedaling resistance according to the user's physiological characteristics and/or a rate of perceived exertion regarding a physical activity.

21 Claims, 13 Drawing Sheets

(51) Int. Cl.

| | |
|---|---|
| ***A63B 22/06*** | (2006.01) |
| *A63B 21/22* | (2006.01) |
| *A63B 22/00* | (2006.01) |
| *A63B 24/00* | (2006.01) |

(52) U.S. Cl.
CPC . *A63B 2022/002* (2013.01); *A63B 2024/0093* (2013.01); *A63B 2071/063* (2013.01); *A63B 2071/0625* (2013.01); *A63B 2220/34* (2013.01); *A63B 2220/54* (2013.01); *A63B 2225/50* (2013.01); *A63B 2230/305* (2013.01); *A63B 2230/425* (2013.01)

(58) Field of Classification Search
USPC ..... 482/1, 5, 57
See application file for complete search history.

(56) References Cited

U.S. PATENT DOCUMENTS

| | | | | |
|---|---|---|---|---|
| 5,318,487 | A | 6/1994 | Golen et al. | |
| 5,387,164 | A * | 2/1995 | Brown, Jr. | A63B 24/00 482/8 |
| 5,410,472 | A * | 4/1995 | Anderson | A63B 21/00181 482/5 |
| 5,512,025 | A | 4/1996 | Dalebout et al. | |
| 5,598,849 | A | 2/1997 | Browne | |
| 6,033,344 | A * | 3/2000 | Trulaske | A61B 5/0002 482/54 |
| 6,447,424 | B1 | 9/2002 | Ashby et al. | |
| 6,450,922 | B1 | 9/2002 | Henderson et al. | |
| 6,740,007 | B2 | 5/2004 | Gordon et al. | |
| 2004/0077465 | A1 * | 4/2004 | Schmidt | A63B 21/0058 482/57 |
| 2004/0229729 | A1 * | 11/2004 | Albert et al. | 482/8 |
| 2006/0032315 | A1 * | 2/2006 | Saalastic | A61B 5/222 73/808 |
| 2006/0160669 | A1 * | 7/2006 | Lizarralde | A63B 21/0051 482/63 |
| 2007/0042868 | A1 * | 2/2007 | Fisher | A63B 24/0084 482/8 |
| 2009/0312150 | A1 * | 12/2009 | Wu | A63B 22/00 482/6 |
| 2009/0312658 | A1 * | 12/2009 | Thieberger | A63B 24/0062 600/520 |
| 2011/0082397 | A1 * | 4/2011 | Alberts | A61H 1/02 601/26 |
| 2011/0092337 | A1 | 4/2011 | Srinivasan et al. | |
| 2012/0077641 | A1 * | 3/2012 | Dyer et al. | 482/8 |
| 2012/0083705 | A1 * | 4/2012 | Yuen | A61B 5/0002 600/508 |
| 2013/0123071 | A1 * | 5/2013 | Rhea | A63B 24/00 482/8 |

FOREIGN PATENT DOCUMENTS

| | | |
|---|---|---|
| TW | 258931 | 10/1995 |
| TW | 403668 | 9/2000 |
| TW | I220387 | 8/2004 |
| TW | 200950851 | 12/2009 |
| TW | M398440 | 2/2011 |
| TW | 201107017 | 3/2011 |
| TW | 201121616 | 7/2011 |
| TW | 201121625 | 7/2011 |
| TW | M409867 | 8/2011 |
| TW | I357343 | 2/2012 |
| TW | 201208735 | 3/2012 |
| TW | 201212976 | 4/2012 |

OTHER PUBLICATIONS

Guo et al., "Development and Qualitative Assessment of the GAMECycle Exercise System", IEEE Transactions on Neural Systems and Rehabilitation Engineering, Mar. 2006, vol. 14, p. 83-p. 90.

Kamnik et al., "Exercise Device for Upper-Extremity Sensory-Motor Capability Augmentation Based on Magneto-Rheological Fluid Actuator", 19th International Workshop on Robotics in Alpe-Adria-Danube Region, Jun. 2010, p. 71-p. 74.

Chen et al., "Feedback Control of an LVAD Supporting a Failing Cardiovascular System Regulated by the Baroreflex", Proceedings of the 45th IEEE Conference on Decision & Control, Dec. 2006, p. 655-p. 660.

Repperger et al., "Perfect Velocity Tracking for Biomedical Applications Using a Pneumatic Muscle Actuator", Proceedings of the IEEE 2009 National Aerospace & Electronics Conference, Jul. 2009, p. 195-p. 199.

"Office Action of Taiwan Counterpart Application", issued on Apr. 16, 2014, p. 1-p. 5.

"Office Action of China Counterpart Application", issued on Jul. 9, 2015, p. 1-p. 8.

* cited by examiner

| Resistance (%) | Intensity (%) | Heart beat (times/minute) | RPM | RPE |
|---|---|---|---|---|
| R | 0 | 65 | 25.00 | – |
| 5 | 17 | 87 | 50.00 | 7 |
| 15 | 33 | 107 | 50.00 | 10 |
| 25 | 48 | 126 | 50.00 | 13 |
| 35 | 64 | 145 | 50.00 | 14 |
| 45 | 79 | 164 | 0.00 | – |
| 55 | 95 | 184 | 0.00 | – |
| 65 | | | | |
| 75 | | | | |
| 85 | | | | |
| 95 | | | | |

Exercise level recommended by system

Intermediate level

You may also set personal exercise goal and level

- Weight loss goal 2 Kg
- Start date 2012/8/13

Next step

FIG. 8

EXERCISE BIKE AND OPERATION METHOD THEREOF

CROSS-REFERENCE TO RELATED APPLICATION

This application claims the priority benefit of Taiwan application serial no. 101138716, filed on Oct. 19, 2012. The entirety of the above-mentioned patent application is hereby incorporated by reference herein and made a part of this specification.

TECHNICAL FIELD

The disclosure relates to a bicycle and an operation method of the bicycle.

BACKGROUND

An indoor exercise bike (i.e., a stationary bike) allows a user to get exercise within limited space as if the user rides on an exercise bike on the road and performs pedaling activities. The conventional stationary bike enables the user to manually adjust or set up the resistance level (intensity) of the pedaling activity. However, a normal user or an inexperienced user is often unable to determine the proper resistance level. Once the user gets the exercise when the improper or excessively large resistance level is given, the user may not achieve the desired effects. What is more, the user may suffer from injuries resulting from the exercise. From another perspective, the conventional exercise bike may not be able to instantly and spontaneously adjust the resistance level of the pedaling activity according to the user's physiological changes and the rate of perceived exertion regarding the user's physical activity.

SUMMARY

The disclosure is directed to an exercise bike and an operation method thereof, so as to determine a recommended pedaling resistance according to user's physiological characteristics and/or a rate of perceived exertion regarding the user's physical activity.

In an exemplary embodiment of the disclosure, an exercise bike that includes a pedaling mechanism, a resistance unit, a physiological measurement unit, and a processing unit is provided. A user performs a pedaling activity through the pedaling mechanism. The resistance unit is connected to the pedaling mechanism, and the resistance unit provides and determines a resistance of the pedaling activity The processing unit is coupled to the resistance unit and the physiological measurement unit. When the exercise bike is in a test mode, the processing unit controls the resistance unit to adjust the resistance of the pedaling activity to be a plurality of pedaling resistances and measures user's physiological characteristics through the physiological measurement unit to obtain a plurality of physiological values respectively corresponding to the pedaling resistances. The processing unit respectively calculates the physiological values to obtain a plurality of exercise intensities respectively corresponding to the pedaling resistances and further obtain a first correspondence relationship between the exercise intensities and the pedaling resistances. After the test mode ends, the processing unit determines a recommended pedaling resistance according to the first correspondence relationship, so as to provide a recommended pedaling resistance to the user for performing the pedaling activity when the exercise bike is in a sport mode.

In an exemplary embodiment of the disclosure, an operation method of an exercise bike is provided. The operation method includes: providing a pedaling mechanism to a user for performing a pedaling activity; adjusting a resistance of the pedaling activity to be a plurality of pedaling resistances by a processing unit when the exercise bike is in a test mode; measuring user's physiological characteristics when the exercise bike is in the test mode, so as to obtain a plurality of physiological values respectively corresponding to the pedaling resistances; respectively calculating the physiological values by the processing unit to obtain a plurality of exercise intensities respectively corresponding to the pedaling resistances and further obtain a first correspondence relationship between the exercise intensities and the pedaling resistances; after the test mode ends, determining a recommended pedaling resistance according to the first correspondence relationship by the processing unit; providing the recommended pedaling resistance to the user for performing the pedaling activity when the exercise bike is in a sport mode.

In an exemplary embodiment of the disclosure, an exercise bike that includes a pedaling mechanism, a resistance unit, a guidance unit, and a processing unit is provided. A user performs a pedaling activity through the pedaling mechanism. The resistance unit is connected to the pedaling mechanism, and the resistance unit provides and determines a resistance of the pedaling activity. The processing unit is coupled to the resistance unit and the guidance unit. When the exercise bike is in a test mode, the processing unit controls the resistance unit to adjust the resistance of the pedaling activity to be a plurality of pedaling resistances and inquires a user about a rate of perceived exertion through the guidance unit to obtain a plurality of psychological values respectively corresponding to the pedaling resistances. The processing unit respectively calculates the psychological values to obtain a plurality of exercise intensities respectively corresponding to the pedaling resistances and further obtain a first correspondence relationship between the exercise intensities and the pedaling resistances. After the test mode ends, the processing unit determines a recommended pedaling resistance according to the first correspondence relationship, so as to provide a recommended pedaling resistance to the user for performing the pedaling activity when the exercise bike is in a sport mode.

In an exemplary embodiment of the disclosure, an operation method of a exercise bike is provided. The operation method includes: providing a pedaling mechanism to a user for performing a pedaling activity; adjusting a resistance of the pedaling activity to be a plurality of pedaling resistances by a processing unit when the exercise bike is in a test mode; inquiring the user's about a rate of perceived exertion when the exercise bike is in the test mode, so as to obtain a plurality of psychological values respectively corresponding to the pedaling resistances; respectively calculating the psychological values by the processing unit to obtain a plurality of exercise intensities respectively corresponding to the pedaling resistances and further obtain a first correspondence relationship between the exercise intensities and the pedaling resistances; after the test mode ends, determining a recommended pedaling resistance according to the first correspondence relationship by the processing unit; providing the recommended pedaling resistance to the user for performing the pedaling activity when the exercise bike is in a sport mode.

In view of the above, an exemplary embodiment of the disclosure provides the exercise bike and the operation method of the exercise bike. According to the user's physiological characteristics and/or the rate of perceived exertion regarding the user's physical activity, the exercise bike is able to obtain the correspondence relationship between the exercise intensities of the user and the pedaling resistances when the exercise bike is in the test mode. The exercise bike may then determine the personalized recommended pedaling resistance according to the correspondence relationship, so as to provide the user with the recommended pedaling resistance for performing the pedaling activity. Hence, the exercise bike is able to automatically find the optimal resistance level (intensity), so as to prevent sports injuries caused by determination of improper resistance level. In another exemplary embodiment of the disclosure, the exercise bike may instantly and spontaneously adjust the resistance level of the pedaling activity according to the user's physiological changes and/or the rate of perceived exertion regarding the user's physical activity.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

FIG. 8 is a schematic image illustrating a test result shown by a guidance unit according to an exemplary embodiment of the disclosure.

DETAILED DESCRIPTION OF DISCLOSED EMBODIMENTS

Figure 1:
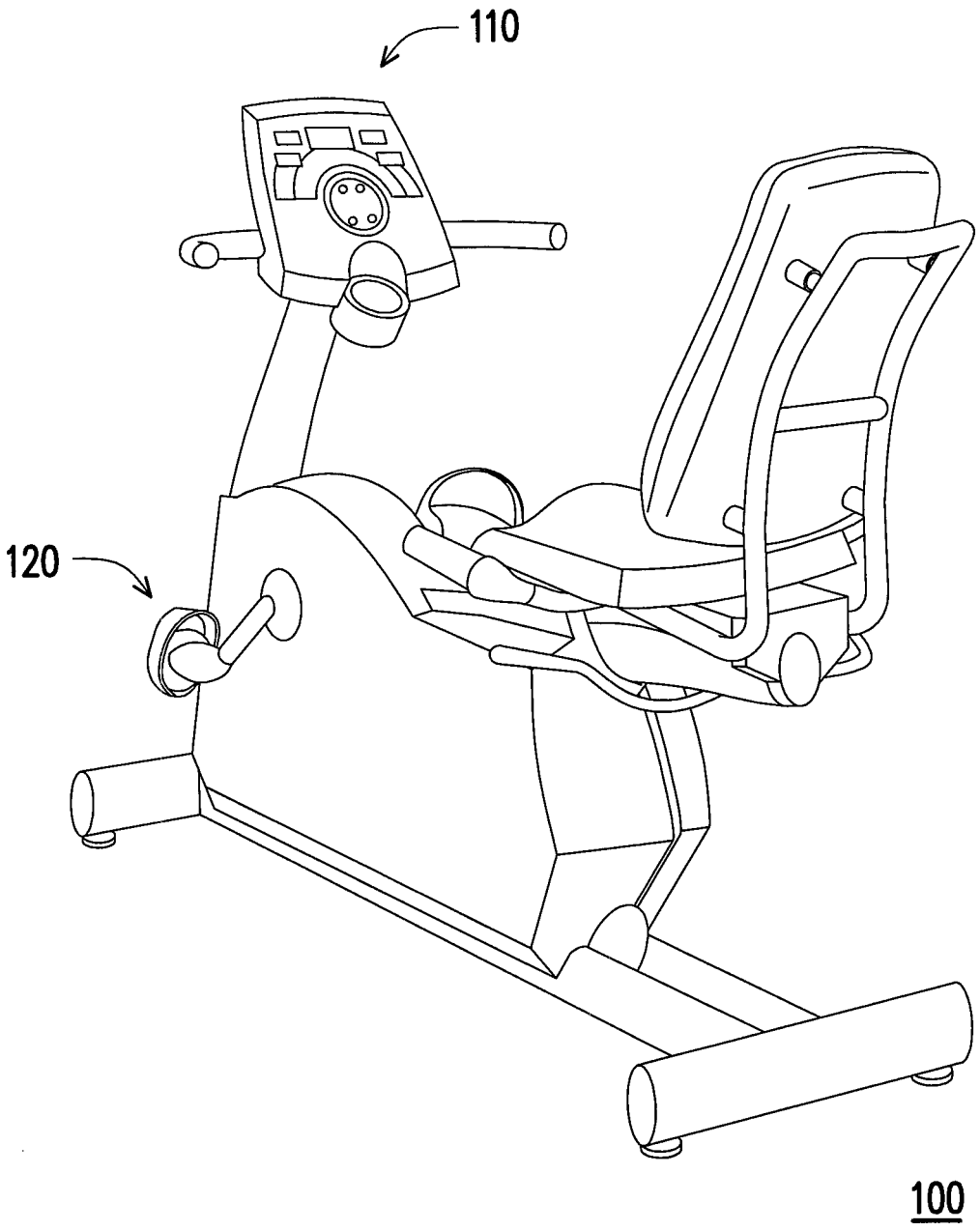
FIG. 1 is a schematic diagram illustrating an appearance of an exercise bike according to an exemplary embodiment of the disclosure.

The word "couple" in the description and claims may refer to any direct or indirect connection. For instance, in the description and claims, if a first device is coupled to a second device, it means that the first device may be directly connected to the second device or may indirectly connected to the second device through another device or by another connection means.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the exercise bike and the operation method thereof described in the exemplary embodiments of the disclosure, the mechanical structure of the exercise bike, the physiological measurement equipment, and the display equipment may all be implemented through conducting existing technologies and thus will not be further explained herein. In addition, the drawings are not at actual size and merely serve to schematically demonstrate the features described in the exemplary embodiments of the disclosure.

FIG. 1 is a schematic diagram illustrating an appearance of an exercise bike 100 according to an exemplary embodiment of the disclosure. The exercise bike 100 includes a guidance unit 110 and a pedaling mechanism 120. A user performs a pedaling activity through the pedaling mechanism 120. The guidance unit 110 may guide the user to perform the pedaling activity and provide the user with a current resistance of the pedaling activity. Based on design requirements of actual products, the guidance unit 110 may include a guidance lamp, a light-emitting diode (LED) display device, a liquid crystal display (LCD) panel, a touch display panel, a sound/voice guidance device, a vibration guidance device, a Braille device used by the visually impaired, and/or any other guidance (display) means. Note that the way to implement the exercise bike 100 described herein should not be subject to the appearance design and the mechanical structure shown in FIG. 1. For instance, in another exemplary embodiment of the disclosure, the exercise bike 100 may also be an exercise bike that may be ridden on a road.

Figure 2:
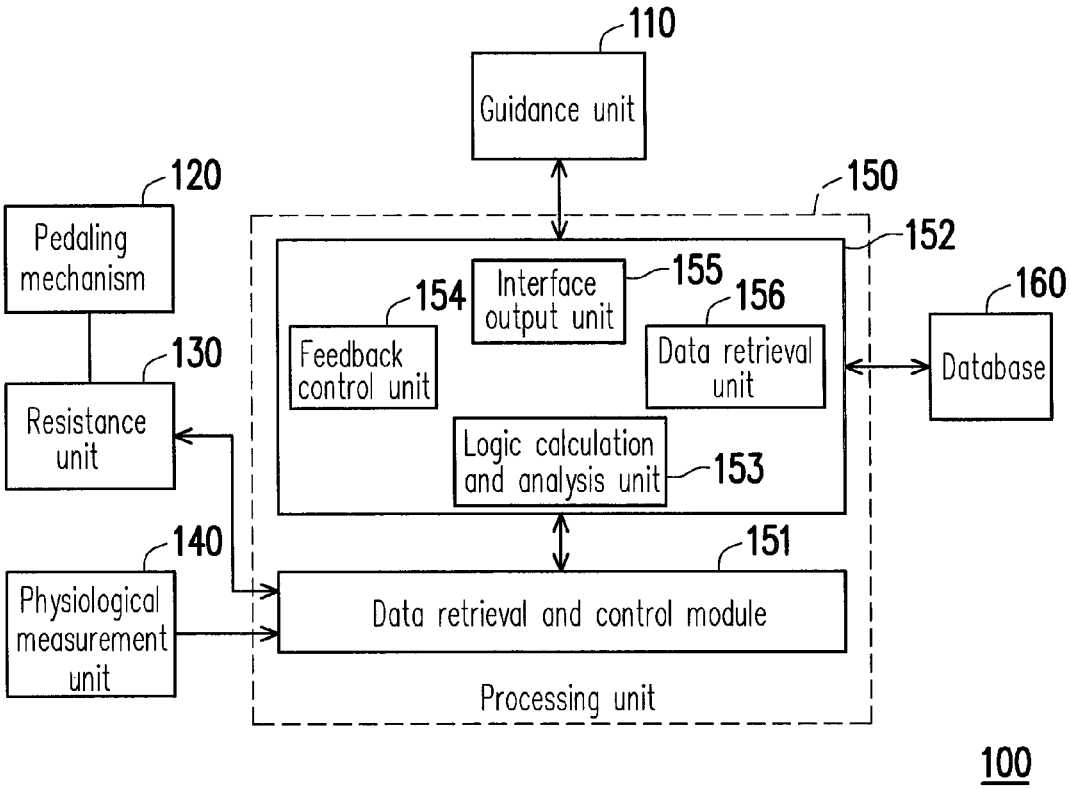
FIG. 2 is a schematic block diagram illustrating functions of an exercise bike according to an exemplary embodiment of the disclosure.

FIG. 2 is a schematic block diagram illustrating functions of an exercise bike 100 according to an exemplary embodiment of the disclosure. With reference to FIG. 2, the exercise bike 100 further includes a resistance unit 130, a physiological measurement unit (PMU) 140, a processing unit 150, and a database 160. The resistance unit 130 is connected to the pedaling mechanism 120, so as to provide and determine a resistance of the pedaling activity. The resistance unit 130 is coupled to the processing unit 150. Here, the resistance unit 130 may measure a mechanical signal of the pedaling mechanism 120, e.g., a rotational speed in unit of revolutions-per-minute (RPM), status of a motor resistance device, a torque sensor value, etc. Besides, the resistance unit 130 converts the mechanical signal of the pedaling mechanism 120 into a streaming signal and transmits the streaming signal to the processing unit 150. According to a control command from the processing unit 150, the resistance unit 130 correspondingly determines/adjusts the resistance of the pedaling activity of the pedaling mechanism 120.

According to the design requirements of the actual products, the resistance unit 130 may be implemented in various different ways, so as to provide the resistance of the pedaling activity. For instance, the resistance unit 130 may generate the resistance of the pedaling activity in a mechanical manner (e.g., through friction, fluid resistance, or damping) or in an electromagnetic manner. The processing unit 150 reads and calculates user's information (i.e., a physiological signal and/or a psychological signal) and transmits a resistance adjustment command (i.e., a control command) to the resistance unit 130 according to the calculation result, such that the resistance of the pedaling activity of the pedaling mechanism 120 may be further modified to the pedaling resistance suitable for the user.

Figure 3:
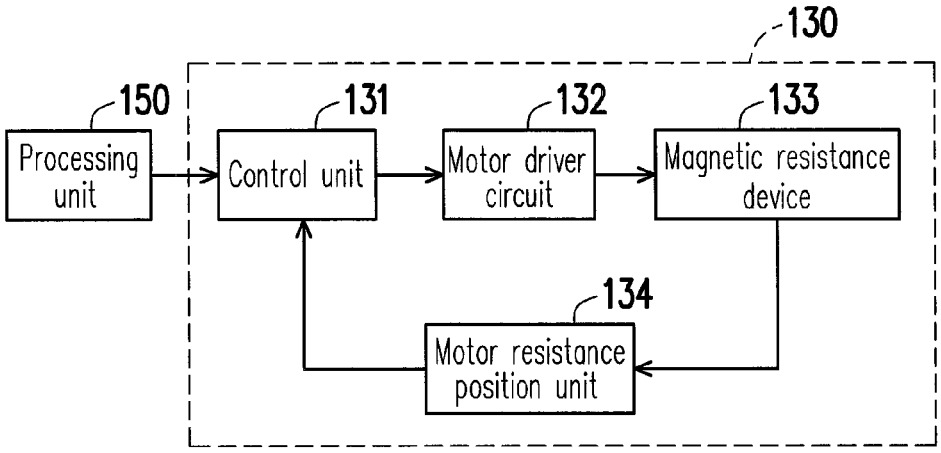
FIG. 3 is a schematic block diagram illustrating functions of a resistance unit according to an exemplary embodiment of the disclosure.

FIG. 3 is a schematic block diagram illustrating functions of the resistance unit 130 according to an exemplary embodiment of the disclosure. The resistance unit 130 includes a control unit 131, a motor driver circuit 132, a magnetic resistance device 133, and a motor resistance position unit 134. The control unit 131 receives a resistance command from the processing unit 150. Specifically, after receiving the command from the processing unit 150, the control unit 131 converts the command from the processing unit 150 into the resistance command (e.g., a command of forward rotation, a command of reverse rotation, or a command to stop). The motor driver circuit 132 is coupled to the control unit 131. After receiving the resistance command from the control unit 131, the motor driver circuit 132 converts the resistance command from the control unit 131 into a motor driver signal and drives the magnetic resistance device 133 to rotate. The magnetic resistance device 133 is coupled to the motor driver circuit 132. According to the motor driver signal, the magnetic resistance device 133 provides and determines the resistance of the pedaling activity of the pedaling mechanism 120.

The motor resistance position unit 134 is coupled between the magnetic resistance device 133 and the control unit 131. After driven and rotated by the magnetic resistance device 133, the motor resistance position unit 134 generates a resistance position where the magnetic resistance device is currently located and feeds back the resistance position to the control unit 131. Therefore, the control unit 131 is able to inform the processing unit 150 of the current resistance of the pedaling activity. The control unit 131 determines/compares whether the current resistance position (level) is the resistance position (level) designated by the processing unit 150 and makes correction in real time according to the determination/comparison result. Since the damping variation resulting from the long-time use of the magnetic resistance device 133 may cause the difference between the final resistance position and the default resistance location, the control unit 131 needs to make correction if it is necessary. For instance, if the motor resistance position unit 134 reports that the current resistance position (level) is 9, the control unit 131 automatically issues the command of "forward rotation". After the current resistance position (level) reaches 10, the control unit 131 then issues the command to "stop".

In another example, it is assumed that the resistance adjustment command issued by the processing unit 150 represents that the resistance level is 10. The control unit 131 determines whether the current resistance position (level) reported by the motor resistance position unit 134 is 10. If the current resistance position (level) is 15, the control unit 131 automatically issues the command of "reverse rotation". After the current resistance position (level) reported by the motor resistance position unit 134 is 10, the control unit 131 then issues the command to "stop". If the resistance adjustment command issued by the processing unit 150 represents that the resistance level is 20, and the control unit 131 determines that the current resistance position (level) reported by the motor resistance position unit 134 is 10, the control unit 131 automatically issues the command of "forward rotation". After the current resistance position (level) reported by the motor resistance position unit 134 is 20, the control unit 131 then issues the command to "stop".

With reference to FIG. 2, the PMU 140 is coupled to the processing unit 150. The PMU 140 may measure the physiological characteristics of the user. Here, the PMU 140 may be implemented in various ways. For instance, the PMU 140 may include a heart rate measurement device (or an electrocardiogram sensor) which may detect the heart rate of the user and use the heart rate as the physiological characteristics of the user. In addition, the PMU 140 may be worn, adhered, or put on the user's body to measure the physiological characteristics of the user. In some exemplary embodiments, the PMU 140 may be fixed to a handlebar, a seat pad, and/or a back support, so as to measure the physiological characteristics of the user. In some exemplary embodiments, the PMU 140 may also measure the physiological characteristics of the user through a non-contact physiological measurement device or in other manner.

The PMU 140 may send the measurement result back to the processing unit 150 through cable transmission or wireless connection. For instance, the PMU 140 may obtain the heart rate of the user by interpreting an electrical activity of the user's heart through electrocardiography, measuring heart beats and pulses of the user, detecting blood flow of the user, applying an infrared ray (IR) sensor, employing an ultra wide band (UWB) sensor, and so forth, and the result is transmitted to the processing unit 150 through wireless connection, e.g., by Bluetooth, wireless network, and so on. However, the disclosure is not limited thereto. In another exemplary embodiment of the disclosure, the PMU 140 may also apply a cable (e.g., a twisted pair cable, a coaxial cable, or optic fiber) to transmit the result to the processing unit 150.

The database 160 is coupled to the processing unit 150. Here, the database 160 stores basic information and historical information of the user. The information stored in the database 160 may include gender, age, hobbies, facial features, previous use record, and/or other information of the user. Through storage of information, the database 160 may allow the user to set up the exercise data more rapidly when the user again uses the exercise bike.

The processing unit 150 includes a data retrieval and control module 151 and an interactive feedback module 152. The data retrieval and control module 151 receives and converts the streaming signal of the resistance unit 130 and the physiological signal of the PMU 140. The interactive feedback module 152 receives the streaming signal and the physiological signal from the data retrieval and control module 151 and generates a control command signal. Here, the interactive feedback module 152 includes a logic calculation and analysis unit 153, a feedback control unit 154, an interface output unit 155, and a data retrieval unit 156. The logic calculation and analysis unit 153 calculates the streaming signal and the physiological signal. The feedback control unit 154 converts the calculated streaming signal and the calculated physiological signal into a feedback control command. The interface output unit 155 outputs information of personalized interactive results. The data retrieval unit 156 retrieves the information from the database 160 and transmits the information to the logic calculation and analysis unit 153. The data retrieval unit 156 also stores information to the database 160. The feedback control command converted and generated by the interactive feedback module 152 is converted into a resistance control command by the data retrieval and control module 151 and transmitted to the resistance unit 130.

Figure 4:
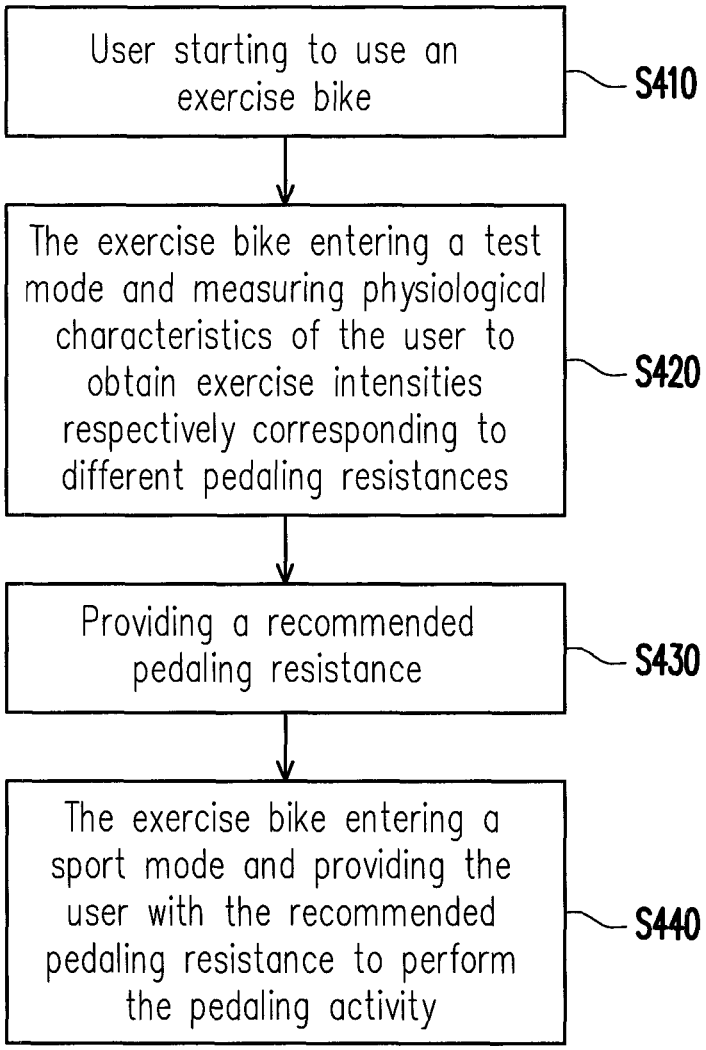
FIG. 4 is a schematic flow chart illustrating an operation method of an exercise bike according to an exemplary embodiment of the disclosure.

FIG. 4 is a schematic flow chart illustrating an operation method of an exercise bike according to an exemplary embodiment of the disclosure. With reference to FIG. 2 and FIG. 4, in step S410, a user starts to use the exercise bike 100. In step S420, the exercise bike 100 enters a test mode, so as to learn the user's maximum physical load and perception exertion regarding physical activity in the event that different relative resistance levels are given. In the test mode, the total exercise time may be set to be 10 minutes or may be adjusted by the user. In step S420, when the exercise bike 100 is in the test mode, the processing unit 150 may guide the user through the guidance unit 110 (e.g., through sound, light, rhythm, a display image, etc.) to maintain a rotational speed of the exercise bike 100 to be a specific test rotational speed, and the processing unit 150 controls the resistance unit 130 to adjust the resistance of the pedaling activity to be a plurality of pedaling resistances. For instance, in the test mode, the resistance unit 130 periodically (in every sub-test time interval, e.g., 1 minute) changes the resistance of the pedaling activity. The pedaling resistances may be changed sequentially from the lowest level to the highest level, e.g., from the resistance position (level) 1 to the resistance position (level) 10. If the resistance level is in unit of percentage, the pedaling resistance level may be changed sequentially in the manner of 5%, 15%, 25%, . . . , and 95%. In the sub-test time intervals, the processing unit 150 respectively measures the physiological characteristics (e.g., the heart rate) of the user through the PMU 140, so as to obtain physiological values respectively corresponding to different pedaling resistances in these sub-test time intervals. Besides, in each sub-test time interval, the processing unit 150 may inquire the user about a rate of perceived exertion regarding the user's physical activity through the touch display panel of the guidance unit 110, so as to learn the physical and psychological performance of the user. The processing unit 150 respectively calculates the physiological values to obtain a plurality of exercise intensities respectively corresponding to the pedaling resistances and further obtain a correspondence relationship (hereinafter "the first correspondence relationship") between the exercise intensities and the pedaling resistances. The processing unit 150 may store both the basic information of the user and the first correspondence relationship into the database 160.

In the test mode, when the user feels that he or she may not be able to complete the exercise test, the user may inform the processing unit 150 of ending the test mode through a predetermined mechanism (e.g., a button, voice, hand gestures, or the like). Besides, in the test mode, the processing unit 150 may through the guidance unit 110 inform the user of maintaining the rotational speed to be around a predetermined rotational speed (e.g., 50 RPM). When the rotational speed of the pedaling activity is faster than the predetermined rotational speed, the processing unit 150 may warn the user through the guidance unit 110. When the rotational speed of the pedaling activity is slower than the predetermined rotational speed for a period of time (e.g., half a minute), it indicates that the user is physically exhausted, and therefore the processing unit 150 directly ends the test mode. If the user's heart rate fluctuates too much, the processing unit 150 also displays a warning message through the guidance unit 110. In consideration of the user's safety, in the test mode, if the user's heart rate exceeds a safety value, the processing unit 150 may immediately send a warning message through the guidance unit 110 and ask the user to ride the exercise bike slowly for a period of time (e.g., 1 minute). During this time period, the pedaling resistance level is automatically reduced to 5%, for instance, and the user is then asked to leave the exercise bike and take a rest. The safety value may be determined according to a medical estimation. For instance, the safety value may be set as 85% of the maximum heart rate (i.e., 220—age).

Figure 5:
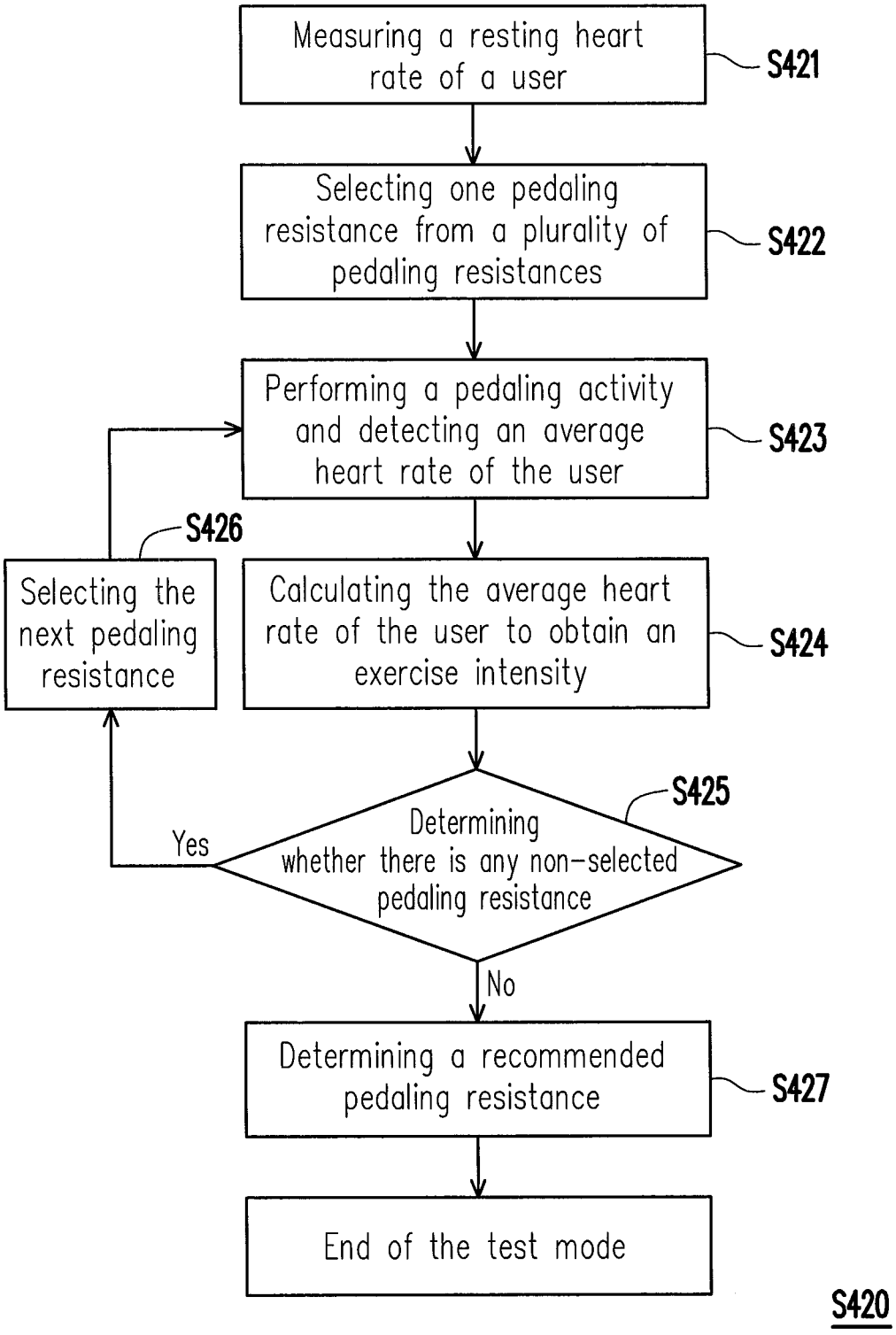
FIG. 5 is a schematic flow chart illustrating the test mode depicted in FIG. 4 according to an exemplary embodiment of the disclosure.

FIG. 5 is a schematic flow chart illustrating the test mode (i.e., step S420) depicted in FIG. 4 according to an exemplary embodiment of the disclosure. With reference to FIG. 2 and FIG. 5, in step S421, the processing unit 150 measures the resting heart rate RHR of the user through the PMU 140 and stores the resting heart rate RHR into the database 160. In particular, before the exercise bike enters the test mode (i.e., prior to step S420), the processing unit 150 detects the heart rate of the user through the PMU 140 and sets the detected heart rate as the resting heart rate RHR of the user.

The processing unit 150 then selects one of the pedaling resistances to perform a phase-one pedaling test (in step S422). For instance, the processing unit 150 selects the smallest pedaling resistance (5%) from the resistances at different resistance levels of 5%, 15%, 25%, . . . , and 95% and thereby sets the pedaling resistance of the resistance unit 130. After the processing unit 150 determines the pedaling resistance of the resistance unit 130 to be at the resistance level of 5%, the processing unit 150 performs the step S423, so as to allow the user to perform the pedaling activity in one sub-test time interval (e.g., 1 minute). Through the PMU 140, the processing unit 150 is able to detect the average heart rate AHR of the user during this sub-test time interval. So far, the user completes the phase-one pedaling test.

After the step S423 is completed, the processing unit 150 performs step S424 to obtain the exercise intensity by calculating the average heart rate AHR. For instance, in the present exemplary embodiment, the processing unit 150 calculates an estimated maximum heart rate MHR of the user and the user's exercise intensity ES by applying the equations (1) and (2):

$$MHR=220-Age \quad \text{Equation (1)}$$

$$ES=(AHR-RHR)/(MHR-RHR) \quad \text{Equation (2)}$$

The processing unit 150 obtains the user's age Age from the database 160 and thereby calculates the estimated maximum heart rate MHR by applying the equation (1). After obtaining the maximum heart rate MHR, the processing unit 150 calculates the user's exercise intensity ES by applying the equation (2). The processing unit 150 may then store the correspondence relationship between the pedaling resistance level (e.g., 5%) and the exercise intensity ES into the database 160.

Figure 6:
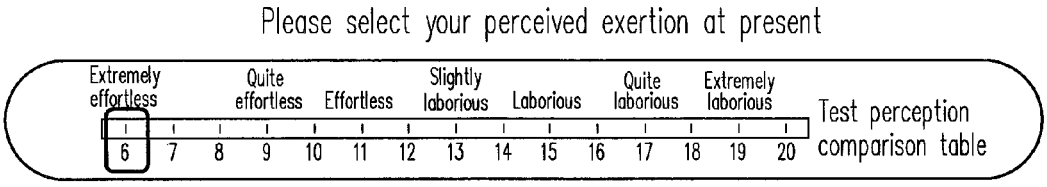
FIG. 6 is a schematic diagram illustrating an image on which a guidance unit inquires a user about a rate of perceived exertion according to an exemplary embodiment of the disclosure.

In step S424, the processing unit 150 may also inquire the user about a rate of perceived exertion (RPE), so as to obtain a plurality of psychological values RPE respectively corresponding to the pedaling resistances. FIG. 6 is a schematic diagram illustrating an image on which a guidance unit 110 inquires the user about a rate of perceived exertion according to an exemplary embodiment of the disclosure. The touch display panel of the guidance unit 110 displays a plurality of perception words and a plurality of psychological values RPE, as shown in FIG. 6. The perception words correspond to different psychological values RPE. Besides, the guidance unit 110 is able to receive a touch selection of the user. For instance, the user may select the psychological values RPE on the image shown in FIG. 6 through the touch display panel of the guidance unit 110. The processing unit 150 then generates the corresponding psychological values RPE according to the touch selection of the user. That is, the processing unit 150 in step S424 is able to measure the physiological values and the psychological values. Specifically, the processing unit 150 may store a correspondence relationship (hereinafter "the second correspondence relationship") between the psychological values RPE of the user and the physiological values (e.g., the average heart beat AHR) of the user into the database 160. The second correspondence relationship stored in the database 160 may be provided in case that the PMU 140 is not employed, which will be elaborated later with reference to FIG. 13 to FIG. 15.

After the step S424 is completed, the processing unit 150 performs step S425 to determine whether there is any non-selected pedaling resistance. For instance, the resistance with the resistance level 5% is used by the processing unit 150 in the phase-one pedaling test described above, while the resistances with the resistance levels 15%, 25%, . . . , and 95% are yet selected and used. Hence, the processing unit 150 in step S426 selects the next pedaling resistance. For instance, the processing unit 150 selects the lowest pedaling resistance level (15%) from the resistance levels of 15%, 25%, . . . , and 95% and thereby sets the pedaling resistance of the resistance unit 130.

After the processing unit 150 determines the pedaling resistance of the resistance unit 130 to be at the resistance level 15%, the processing unit 150 performs the steps S423, S424, and S425 in a second sub-test time interval. So far, the user completes the phase-two pedaling test, and the rest may be deduced from the above.

As long as the processing unit 150 determines that there is no non-selected pedaling resistance, the heart rate of the user exceeds the safety value, or the exercise intensity ES of the user exceeds the safety value (e.g. 95%), the processing unit 150 performs step S427 to determine a recommended pedaling resistance.

Figure 7:
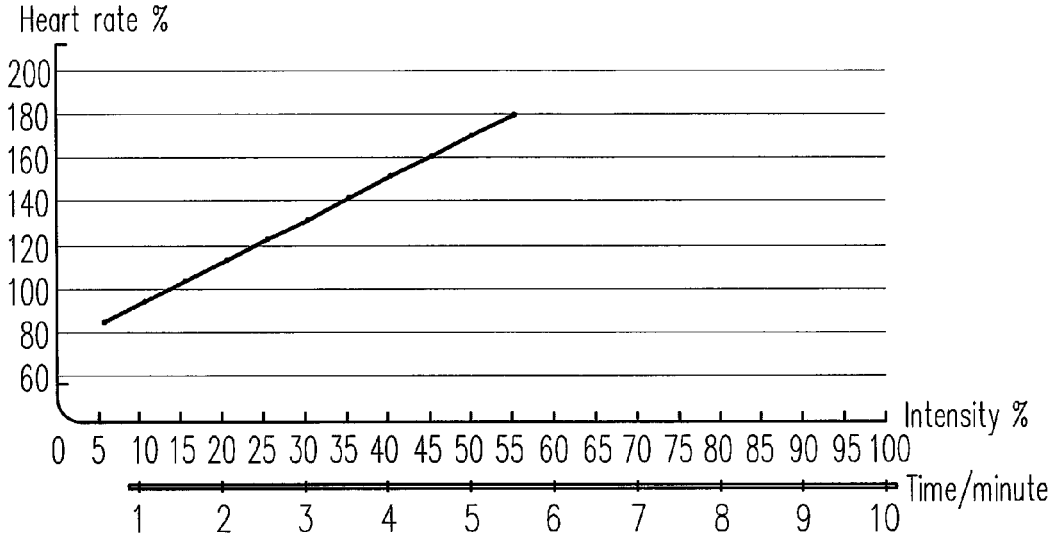
FIG. 7 is a schematic curve illustrating the relationship between heart rates and exercise intensities according to an exemplary embodiment of the disclosure.

FIG. 7 is a schematic curve illustrating the relationship between heart rates and exercise intensities ES according to an exemplary embodiment of the disclosure. In FIG. 7, the horizontal axis represents the exercise intensities ES, and the perpendicular axis represents the average heart rates AHR. After entry into the test mode (after step S420), a regression curve shown in FIG. 7 may be obtained.

The processing unit 150 may display the test result in the test mode through the guidance unit 110. FIG. 8 is a schematic image illustrating a test result shown by the guidance unit 110 according to an exemplary embodiment of the disclosure. With reference to FIG. 8, the user may learn his or her condition and physical performance during the exercise; besides, the user is able to learn the correspondence relationship among the pedaling resistance (the first column in FIG. 8), the exercise intensity ES (the second column in FIG. 8), the average heart rate AHR (the third column in FIG. 8), the rotational speed (the fourth column in FIG. 8), and the psychological value (the fifth column in FIG. 8) within every sub-test time interval when the exercise bike is in the test mode.

In the present exemplary embodiment, the exercise intensity ES within the resistance range from 25% to 50% is defined as the beginner's level, the exercise intensity ES within the resistance range from 50% to 75% is defined as the intermediate level, and the exercise intensity ES within the resistance range from 75% to 100% is defined as the advanced level. According to the test result shown in FIG. 8, the exercise intensity ES defined as the intermediate level (within the resistance range from 50% to 75%) is 64, and the corresponding pedaling resistance level is 35%. Hence, the processing unit 150 described herein may select the pedaling resistance level (35%) to be the recommended pedaling resistance in step S427 shown in FIG. 5.

With reference to FIG. 4, after the test mode (step S420) is finished, the processing unit 150 performs step S430, so as to provide the recommended pedaling resistance (determined in step S420) to the user. The way to provide the recommended pedaling resistance in step S430 may be done by the processing unit 150 which displays the recommended pedaling resistance through the guidance unit 110 for the user's choice. In another exemplary embodiment, the processing unit 150 in step S430 directly controls the resistance unit to adjust the resistance of the pedaling activity to be the recommended pedaling resistance, so as to provide the recommended pedaling resistance to the user for performing the pedaling activity.

In step S430, the exercise bike may further enter a sport mode. According to the test result obtained in step S420 and the goal of exercise set by the user, a completely customized menu may be provided in step S420 when the exercise bike is in the sport mode. The menu provides plural sport modes (with different resistances or within different exercise periods), e.g., a beginner's level, an intermediate level, and an advanced level. The function of setting the goal of exercise may allow the user to determine personal goals, e.g., lose certain weight within a certain period of time.

In step S430, the user may further be provided with sport-related advice. According to the sport mode determined by the user, the processing unit 150 spontaneously provide appropriate sport-related advices according to the test result obtained in step S420, e.g., by presetting a 5-minute warm-up exercise and a 5-minute cool-down exercise, setting the exercise intensity ES of the main exercise to be at the resistance level of 50%, and so forth. The main exercise lasts for a certain period of time, i.e., the beginner's level is 20 minutes, the intermediate level is 30 minutes, and the advanced level is 40 minutes. The user is able to adjust the time spent on each session, i.e., the warm-up session, the main exercise session, and the cool-down session. If the user does not have any corresponding test result recorded in the database 160, the processing unit 150 provides a personalized sport-related advice according to the basic information of the user or provides a normal sport-related advice.

After step S430 is completed, the processing unit 150 provides the recommended pedaling resistance to the user for performing the pedaling activity when the exercise bike is in the sport mode (step S440). In the sport mode, the sport-related physiological measurement and evaluation of sport-related perceived exertion may be conducted instantly according to the user's physical exercise preferences. In step S440, the safety of the user during workout is ensured, and the evaluation result is instantly fed back. Besides, in step S440, the exercise intensity may be dynamically adjusted, the guidance scenario displayed by the guidance unit 110 may be dynamically adjusted, and it is also possible to play the music corresponding to the exercise. In some exemplary embodiments, a "sport training" mode may be chosen in step S440. In some exemplary embodiments, a "three-phase sport" mode may be chosen in step S440. The "three-phase sport" mode includes a resting measurement, a warm-up session, a main exercise session, and a cool-down session, and a recovery measurement. The "sport training" mode includes a warm-up session, a main exercise session, and a cool-down session.

Figure 9:
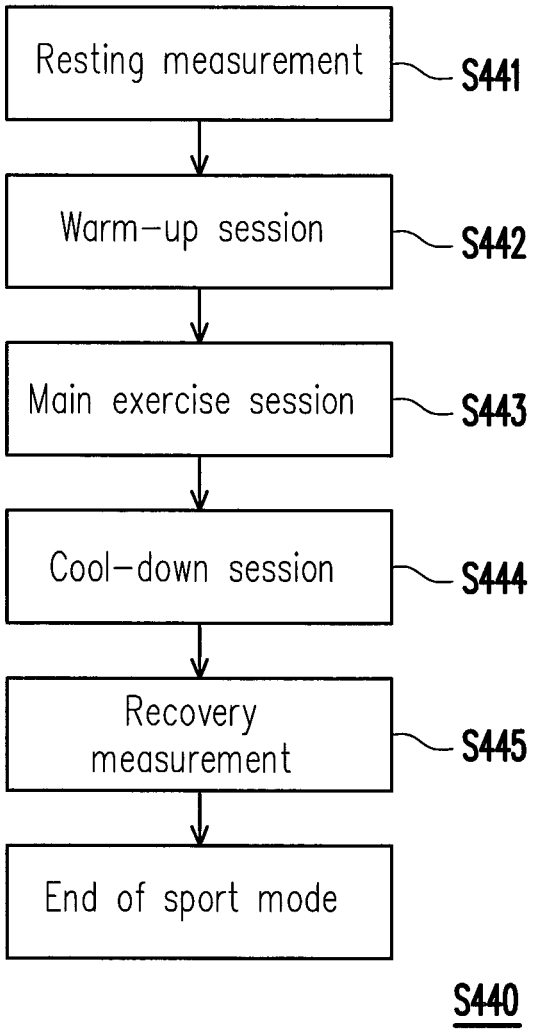
FIG. 9 is a schematic flow chart illustrating the sport mode depicted in FIG. 4 according to an exemplary embodiment of the disclosure.

FIG. 9 is a schematic flow chart illustrating the sport mode (i.e., step S440) depicted in FIG. 4 according to an exemplary embodiment of the disclosure. At the beginning of the "three-phase sport" mode, the processing unit 150 through the PMU 140 performs step S441 to conduct the resting measurement, i.e., to measure a pre-exercise physiological value of the user. In step S441, the processing unit 150 through the guidance unit 110 displays an informing message, a timer, and a heart beat curve diagram, so as to guide the user to measure the physiological characteristics of the user (e.g., heart rate) prior to the exercise. In another exemplary embodiment, the processing unit 150 through the guidance unit 110 inquires the user about a pre-exercise psychological value of the user in step S441.

After the step S441 is completed, the processing unit 150 through the guidance unit 110 guides the user to run a warm-up session in step S442. The processing unit 150 monitors the physiological characteristics of the user through the PMU 140 and instantly displays information including the target heart beat, the real-time heart beat, calories, the rotational speed (RPM), the exercise intensity ES, and the rate of perceived exertion RPE through the guidance unit 110.

After the step S442 is completed, the processing unit 150 through the guidance unit 110 guides the user to run a main exercise session in step S443. At this time, the processing unit 150 also monitors the physiological characteristics of the user through the PMU 140 and instantly displays information including the target heart beat, the real-time heart beat, calories, the rotational speed (RPM), the exercise intensity ES, and the rate of perceived exertion RPE through the guidance unit 110. According to the heart rate of the user or the rate of perceived exertion RPE, the processing unit 150 is able to dynamically adjust the resistance level of the pedaling activity. Additionally, the processing unit 150 periodically (e.g., every minute) compares the real-time heart beat of the user with the target heart beat. If the difference between the real-time heart beat of the user and the target heart beat exceeds a preset range (e.g., 5), the processing unit 150 automatically reduces the resistance level of the pedaling activity. On the contrary, if the difference between the real-time heart beat of the user and the target heart beat lags behind the preset range (e.g., 5), the processing unit 150 automatically raise the resistance level of the pedaling activity.

After the step S443 is completed, the processing unit 150 through the guidance unit 110 guides the user to run a cool-down session in step S444. At this time, the processing unit 150 also monitors the physiological characteristics of the user through the PMU 140 and instantly displays information including the target heart beat, the real-time heart beat, calories, the rotational speed (RPM), the exercise intensity ES, and the rate of perceived exertion RPE through the guidance unit 110. In the warm-up session, the main exercise session, and the cool-down session, the processing unit 150 may through the guidance unit 110 displays the scenario corresponding to the exercise intensity and plays the music corresponding to the exercise intensity.

Besides, the processing unit 150 through the guidance unit 110 periodically inquires the user about the rate of perceived exertion RPE, as exemplarily shown in FIG. 6. If the user does not set up the rate of perceived exertion RPE within several seconds (e.g., 20 seconds), the processing unit 150 automatically skips to the next display image. When there is no heart rate measurement device, the processing unit 150 is able to automatically adjust the resistance of the pedaling activity according to the rate of perceived exertion RPE. For instance, the processing unit 150 may compare the target psychological value with the actual psychological value RPE and dynamically and automatically adjust the resistance of the pedaling activity.

After the step S444 is completed, the processing unit 150 through the guidance unit 110 guides the user to conduct the recovery measurement in step S445, i.e., to measure a post-exercise physiological value of the user. In step S445, the processing unit 150 through the guidance unit 110 displays an informing message, a timer, and a heart beat curve diagram, so as to guide the user to measure the physiological characteristics of the user (e.g., heart rate) after the exercise. In another exemplary embodiment, the processing unit 150 through the guidance unit 110 inquires the user about the post-exercise psychological value of the user in step S445.

In view of the above, in the sport mode, the processing unit 150 in step S440 measures an exercise physiological or psychological value of the user through the PMU 140 and controls the resistance unit 130 to correspondingly and dynamically adjust the resistance of the pedaling activity according to the exercise physiological or psychological value. That is, when the user gets the exercise on the exercise bike 100, the user's physiological characteristics of the user (e.g., the heart rate) and/or the psychological values (e.g., perceived exertion) are monitored and timely fed back to the resistance unit 130 of the exercise bike 100 in response to the use condition of the user; thereby, injuries resulting from the exercise may be prevented.

Figure 10:
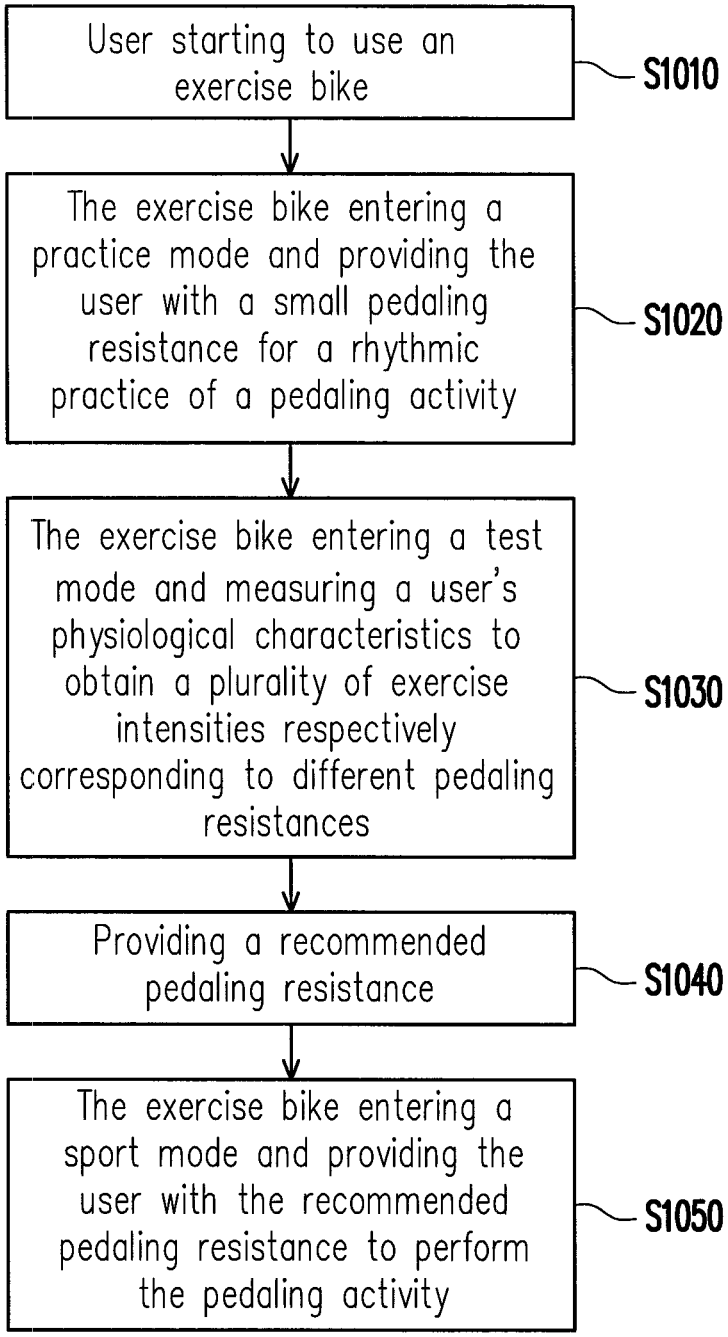
FIG. 10 is a schematic flow chart illustrating an operation method of an exercise bike according to another exemplary embodiment of the disclosure.

FIG. 10 is a schematic flow chart illustrating an operation method of an exercise bike according to another exemplary embodiment of the disclosure. Since the details of steps S1010, S1030, S1040, and S1050 shown in FIG. 10 may be referred to as the details of steps S410, S420, S430, and S440 depicted in FIG. 4, no further description in this regard is provided hereinafter. Before the exercise bike enters the test mode (step S1030), the processing unit 150 controls the resistance unit 130 to adjust the resistance of the pedaling activity to be a specific pedaling resistance (e.g., a small pedaling resistance or a medium pedaling resistance) when the exercise bike is in a practice mode, so as to provide the user with the specific pedaling resistance for a rhythmic practice of the pedaling activity at a rotational speed. The processing unit 150 monitors whether a rotational speed of the exercise bike 100 complies with a predetermined "practice rotational speed" when the exercise bike 100 is in the practice mode, and the processing unit 150 guides the user through the guidance unit 110 (e.g., through sound, light, rhythm, a display image, etc.) to maintain the rotational speed of the exercise bike 100 to be the practice rotational speed. The predetermined "practice rotational speed" may be any pre-selected rotational speed (e.g., 50 RPM). In the present exemplary embodiment, the predetermined "practice rotational speed" may be the same as the "test rotational speed" when the exercise bike 100 is in the test mode (step S1030).

In step S1020, the user gets the exercise practice by getting accustomed to the rhythm of the rotational speed and thereby obtaining self-perception of physical exercise. In the practice mode (step S1020), the processing unit 150 is pre-determined to provide the low pedaling resistance level, and the processing unit 150 allows the user to set up the "practice rotational speed" (e.g., 40 RPM, 50 RPM, or 60 RPM) for the rhythmic practice of the pedaling activity at a rotational speed. The user may choose from at least one specific pedaling resistance level (e.g., 5% or 10%) in the exercise bike 100, such that the user may get the rhythmic practice of the pedaling activity at a rotational speed for a period of time (e.g., 3 minutes). In the practice mode, the user is required to make sure that the rotational speed of the exercise bike 100 complies with the selected practice rotational speed. After the practice mode ends, the processing unit 150 through the guidance unit 110 displays a coefficient of variation (CV), the average rotational speed (RPM), the average peak torque (Nm), and/or the average work (Watt). If the CV value falls within a safety range (e.g., 5%), the next phase may be adopted after rest (step S1030). The purpose of rest lies in that the user may recover and regain the physical condition as if the user were in rest. For instance, the heart rate of the user after exercise is kept equal to the heart rate of the user in rest. The resting time may be determined by the user or set up in advance, e.g., 3 minutes. If the CV value exceeds the safety range (e.g., 5%), the exercise bike 100 is required to be in the practice mode again (step S1020) until the user gets accustomed to the rhythm of the rotational speed.

Figure 11:
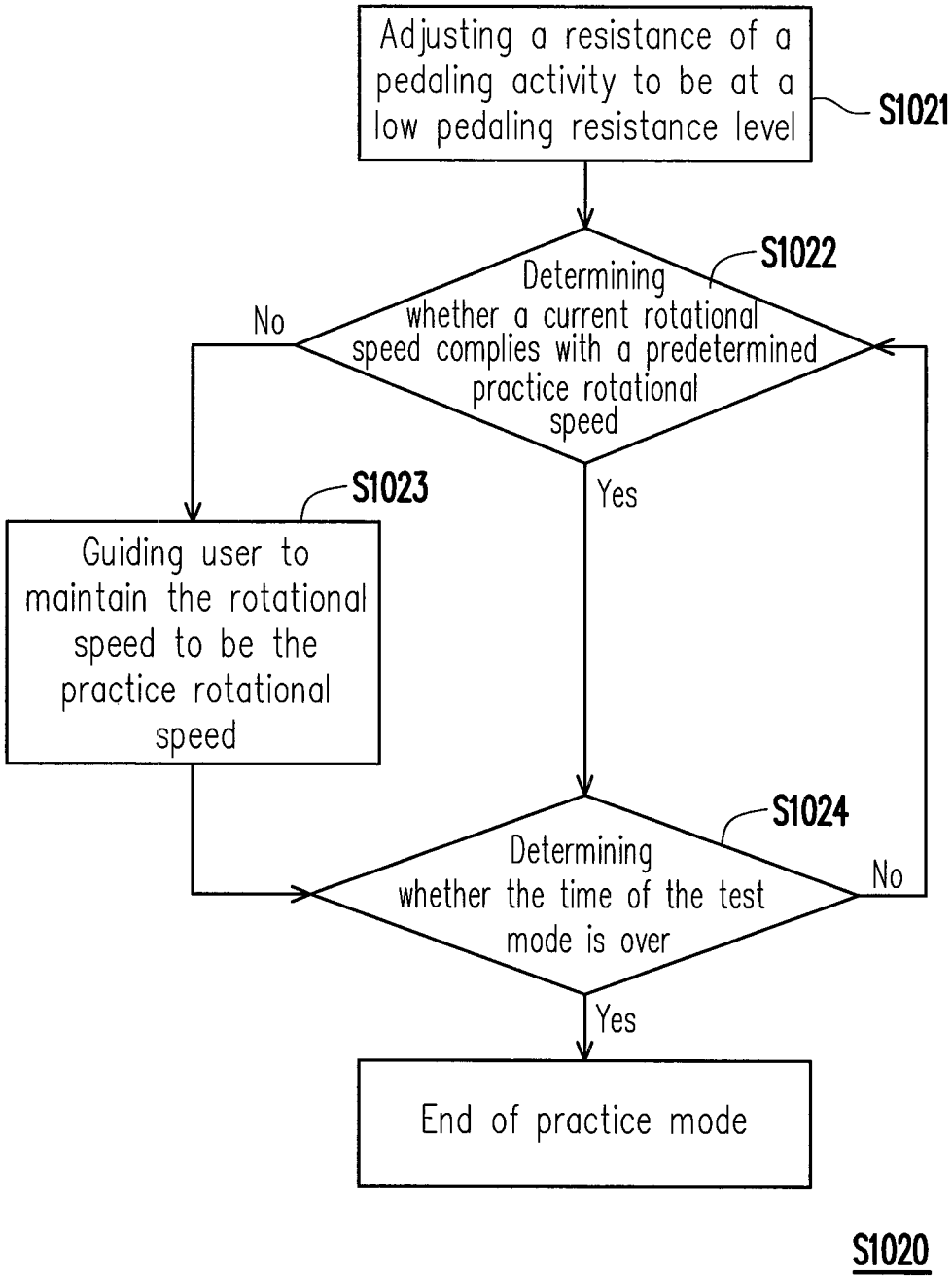
FIG. 11 is a schematic flow chart illustrating the test mode depicted in FIG. 10 according to an exemplary embodiment of the disclosure.

FIG. 11 is a schematic flow chart illustrating the test mode (i.e., step S1020) depicted in FIG. 10 according to an exemplary embodiment of the disclosure. In step S1021, the processing unit 150 sets the resistance of the resistance unit 130 to be at the low pedaling resistance level (e.g., 5% or 10%). In step S1022, the processing unit 150 determines whether the current rotational speed of the exercise bike 100 complies with the predetermined "practice rotational speed" (e.g., 40 RPM, 50 RPM, or 60 RPM). If the current rotational speed of the exercise bike 100 complies with the predetermined "practice rotational speed", the processing unit 150 performs step S1024. Here, the compliance of the current rotational speed of the exercise bike 100 with the predetermined "practice rotational speed" indicates that the difference between the current rotational speed of the exercise bike 100 and the "practice rotational speed" falls within the predetermined range (e.g., 5 RPM). If the current rotational speed of the exercise bike 100 does not comply with the predetermined "practice rotational speed", the processing unit 150 performs step S1024.

In step S1023, the processing unit 150 may guide the user through the guidance unit 110 (e.g., through sound, light, rhythm, etc.) to maintain the rotational speed of the exercise bike 100 to be the practice rotational speed. In step S1024, the processing unit 150 determines whether the time of the test mode is over. If the time of the test mode is not over, the processing unit 150 performs step S1022. If the time of the test mode is over, the processing unit 150 ends the test mode, and the next phase may be adopted after rest (step S1030).

Figure 12:
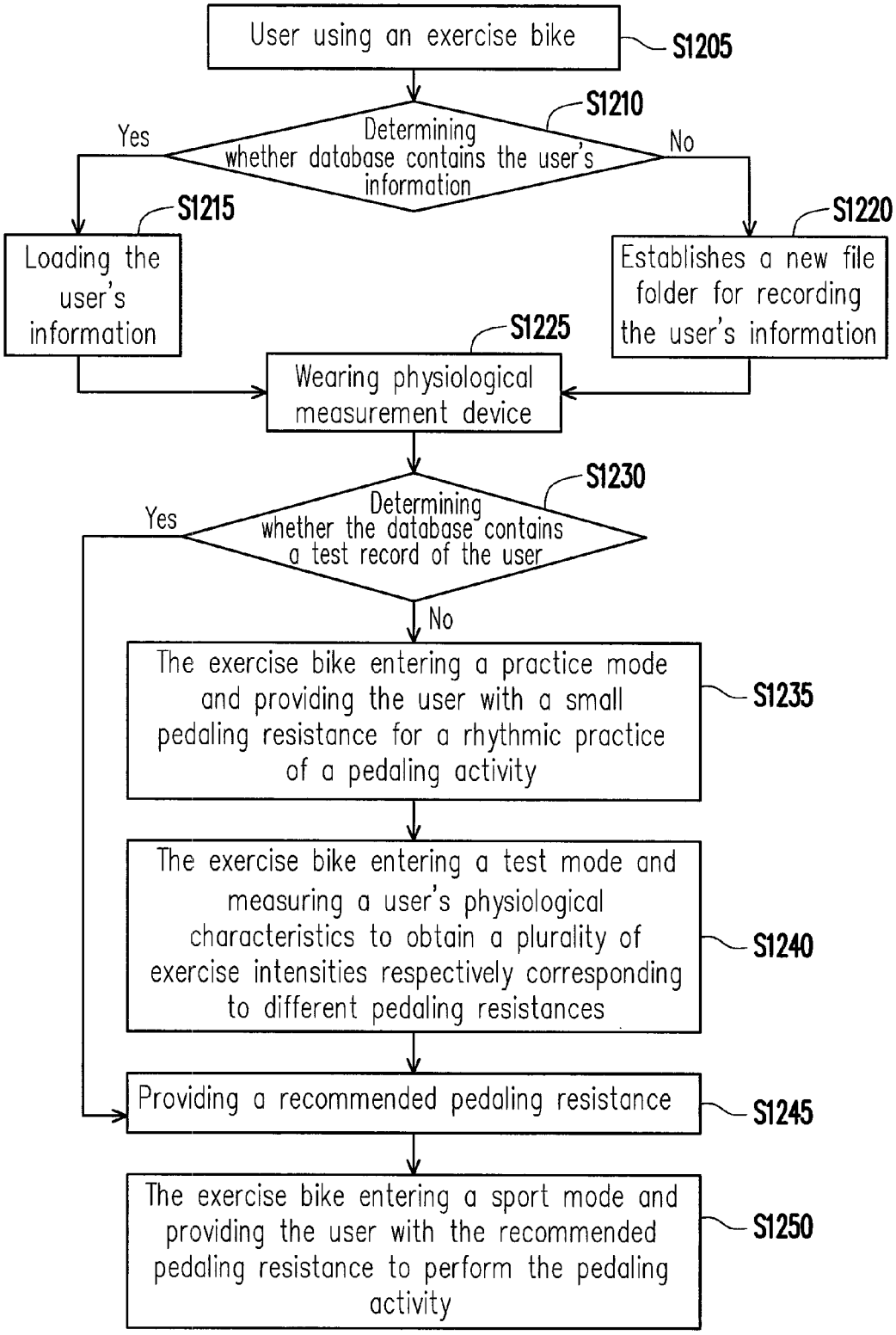
FIG. 12 is a schematic flow chart illustrating an operation method of an exercise bike 100 according to still another exemplary embodiment of the disclosure.

FIG. 12 is a schematic flow chart illustrating an operation method of an exercise bike 100 according to still another exemplary embodiment of the disclosure. Since the details of steps S1205, S1235, S1240, S1245, and S1250 shown in FIG. 12 may be referred to as the details of steps S1010, S1020, S1030, S1040, and S1050 depicted in FIG. 10, no further description in this regard is provided hereinafter. With reference to FIG. 2 and FIG. 12, after the user starts to use the exercise bike 100, in step S1210, the processing unit 150 may through the guidance unit 110 (or through the PMU 140) inquire who the current user is or identify the current user, so as to search the database 160 and find out if the database 160 stores any information (e.g., basic information, test information, etc.) of the user. For instance, the processing unit 150 may through the guidance unit 110 inquires about the user's name and/or password, so as to search the database 160 and find out if the database 160 stores any relevant information. Alternatively, the processing unit 150 may through the guidance unit 110 identify the face of the user, so as to search the database 160 and find out if the database 160 stores any relevant information.

If the database 160 stores the information of the user, the processing unit 150 loads the information of the user from the database 160 in step S1215. For instance, the processing unit 150 may load the basic information of the user previously stored in the database 160, and the basic information may include a nickname, the age, the birthday, the gender, and/or hazardous factors. If the database 160 does not contain the information of the user, the processing unit 150 establishes a new file folder for recording the information of the user in step S1220.

Next, the processing unit 150 performs step S1225, so as to inform the user of using a contact-type or a non-contact-type PMU 140 (e.g., a heart rate measurement device). For instance, the processing unit 150 may ask the user to wear a heart rate measurement device or to tightly hold the PMU 140 which is located on the handlebar of the exercise bike 100. Through the PMU 140, the processing unit 150 is able to monitor the exercise condition of the user. In step S1225, the processing unit 150 may connect the physiological measurement device for further confirmation. In the present embodiment, the user is able to determine whether to wear/use the PMU 140. Based on actual situations, the user may decide to omit step S1225. If the exercise bike is not equipped with the PMU 140, the processing unit 150 may automatically make dynamic adjustment based on the rate of perceived exertion (RPE), which is elaborated below with reference to FIG. 13 and FIG. 15.

The processing unit 150 then performs step S1230 to determine whether the user information file in the database 160 contains the test record of the user. If the database 160 has the test record of the user, step S1245 is performed. If the database 160 does not have the test record of the user, steps S1235 and S1240 are performed to establish the test record for the user and save the test record into the database 160.

The details of steps S1235, S1240, S1245, and S1250 shown in FIG. 12 may be deduced from the details depicted in FIG. 4 and FIG. 10. When the user decides not to use the PMU 140, or when the exercise bike is not equipped with the PMU 140, the details of steps S1235, S1240, S1245, and S1250 shown in FIG. 12 may be deduced from the details depicted in FIG. 13 and FIG. 15 and will be discussed later.

Through establishing the three-phase exercise model (includes the practice mode, the test mode, and the sport mode), the exercise bike 100 is capable of providing appropriate physical training in consideration of the physical condition of each individual. In the practice mode, the user gets accustomed to the rhythm of the physical activity and obtains self-perception of physical exercise when different rotational speed and different pedaling resistance levels are given. The test result sometimes may be deviated because the user is unfamiliar with the stationary bike; however, in the test mode following the practice mode, said deviation may be reduced. Besides, in the test mode, the exercise bike 100 may analyze the user's maximum physical load and/or perception exertion regarding physical activity in the event that different rotational speed and/or different pedaling resistance levels are given. According to the test and analysis result, the exercise bike 100 is able to provide the user with a completely customized menu, such that the physical exercise preferences of the user may be taken into account.

During the exercise, the exercise bike 100 constantly conducts the physiological measurement and/or evaluates the perceived exertion. According to the physiological characteristics collected by the PMU 140 or the rate of perceived exertion regarding the user's physical activity, the exercise bike 100 is capable of performing a feed-back control. Specifically, the safety of the user during workout is ensured, and the evaluation result is instantly fed back, so as to dynamically adjust the exercise intensity and demonstrates the scenario corresponding to the exercise. In the exercise bike 100, the dynamic physiological characteristics of the user and/or the rate of perceived exertion may be continuously collected/evaluated, so as to make instant feed-back for timely adjusting the scenario corresponding to the exercise and changing the pedaling resistance. Thereby, the safety of the pedaling exercise and the effects that can be achieved by the pedaling exercise may both be improved.

Figure 13:
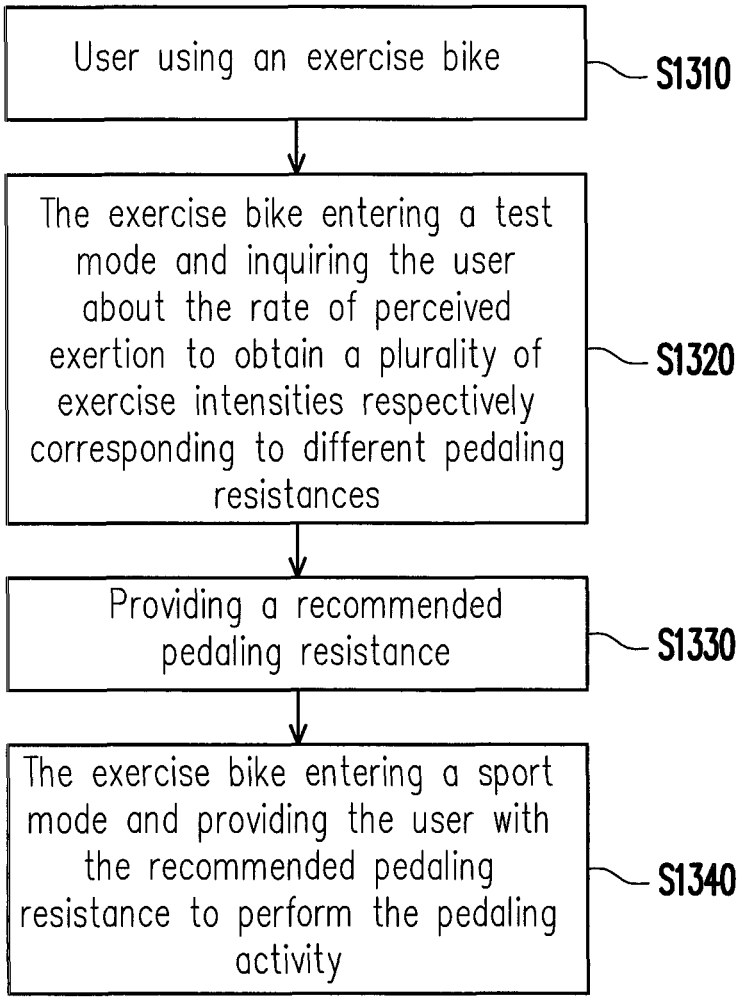
FIG. 13 is a schematic flow chart illustrating an operation method of an exercise bike according to still another exemplary embodiment of the disclosure.

FIG. 13 is a schematic flow chart illustrating an operation method of an exercise bike according to still another exemplary embodiment of the disclosure. Since the details of steps S1310, S1320, S1330, and S1340 shown in FIG. 13 may be referred to as the details of steps S410, S420, S430, and S440 depicted in FIG. 4, no further description in this regard is provided hereinafter. With reference to FIG. 2 and FIG. 13, after the user starts to use the exercise bike 100 (step S1310), the processing unit 150 may perform step S1320 in the test mode, so as to learn the user's maximum physical load and perception exertion regarding physical activity in the event that different relative resistance levels are given. In the test mode (step S1320), the processing unit 150 controls the resistance unit 130 to adjust the resistance of the pedaling activity to be a plurality of pedaling resistances. Besides, when the exercise bike is in the test mode, the processing unit 150 through the guidance unit 110 inquires the user about the rate of perceived exertion, so as to obtain a plurality of different psychological values RPE respectively corresponding to the pedaling resistances. For instance, in the test mode, the resistance unit 130 periodically (in every sub-test time interval, e.g., 1 minute) and sequentially changes the resistance of the pedaling activity. The resistance unit 130 may sequentially change the pedaling resistance level in the manner of 5%, 15%, 25%, . . . , and 95%. After each sub-test time interval ends, the processing unit 150 may inquire the user about the rate of perceived exertion regarding the user's physical activity through the touch display panel of the guidance unit 110, so as to learn the psychological performance (psychological values RPE) of the user. The processing unit 150 respectively calculates the psychological values RPE to obtain a plurality of exercise intensities respectively corresponding to the pedaling resistances and further obtain a first correspondence relationship between the exercise intensities and the pedaling resistances. The processing unit 150 may store both the basic information of the user and the first correspondence relationship into the database 160.

Figure 14:
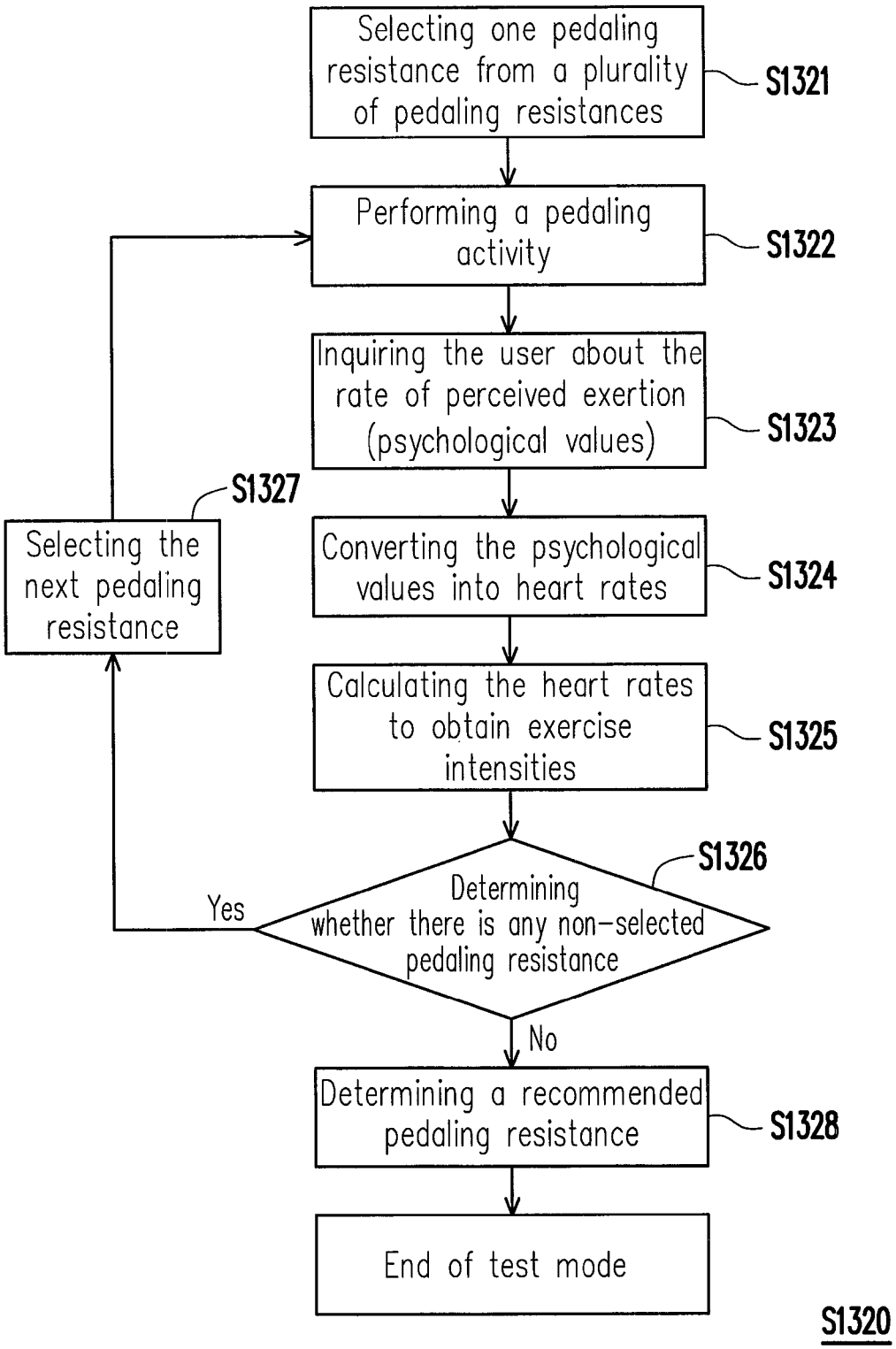
FIG. 14 is a schematic flow chart illustrating the test mode depicted in FIG. 13 according to an exemplary embodiment of the disclosure.

FIG. 14 is a schematic flow chart illustrating the test mode (i.e., step S1320) depicted in FIG. 13 according to an exemplary embodiment of the disclosure. With reference to FIG. 2 and FIG. 14, the processing unit 150 selects one of the pedaling resistances to perform a phase-one pedaling test (in step S1321). For instance, the processing unit 150 selects the smallest pedaling resistance (5%) from the resistances at different resistance levels of 5%, 15%, 25%, . . . , and 95% and thereby sets the pedaling resistance of the resistance unit 130. After the processing unit 150 determines the pedaling resistance of the resistance unit 130 to be at the resistance level of 5%, the processing unit 150 performs the step S1322, so as to allow the user to perform the pedaling activity in one sub-test time interval (e.g., 1 minute). When the sub-time interval ends, the user completes the phase-one pedaling test.

After the step S1322 is completed, the processing unit 150 through the guidance unit 110 inquires the user about the rate of perceived exertion, so as to obtain the psychological value RPE corresponding to the current pedaling resistance. Details of the step S1323 may be referred to as the details shown in FIG. 6, for instance.

It is assumed that the database 160 stores the correspondence relationship (i.e., the second correspondence relationship) between the psychological values RPE of the user and the physiological values (e.g., the average heart beat AHR) of the user. The second correspondence relationship stored in the database 160 may be historical records of the same user previously using the exercise bike 100, which may be referred to as that depicted in FIG. 4. In another exemplary embodiment, the second correspondence relationship stored in the database 160 may be a general correspondence relationship determined according to a medical research method, so as to satisfy different requirements of users. According to the second correspondence relationship stored in the database 160, the processing unit 150 may convert the psychological values RPE into the average heart rates AHR in step S1324.

After obtaining the average heart rates AHR, the processing unit 150 performs step S1325 to obtain the exercise intensities ES by calculating the average heart rates AHR. For instance, in the present exemplary embodiment, the processing unit 150 calculates an estimated maximum heart rate MHR of the user and the user's exercise intensity ES by applying the equations (1) and (2): The processing unit 150 may then store the correspondence relationship (i.e., the first correspondence relationship) between the pedaling resistance level (e.g., 5%) and the exercise intensity ES into the database 160.

After the step S1325 is completed, the processing unit 150 performs step S1326 to determine whether there is any non-selected pedaling resistance. For instance, the resistance with the resistance level 5% is used by the processing unit 150 in the phase-one pedaling test described above, while the resistances with the resistance levels 15%, 25%, . . . , and 95% are yet selected and used. Hence, the processing unit 150 in step S1327 selects the next pedaling resistance. For instance, the processing unit 150 selects the lowest pedaling resistance level (15%) from the resistance levels of 15%, 25%, . . . , and 95% and thereby sets the pedaling resistance of the resistance unit 130. After the processing unit 150 determines the pedaling resistance of the resistance unit 130 to be at the resistance level 15%, the processing unit 150 performs the steps S1322, S1323, S1324, S1325, and S1326 in a second sub-test time interval. So far, the user completes the phase-two pedaling test, and the rest may be deduced from the above.

As long as the processing unit 150 determines that there is no non-selected pedaling resistance, the heart rate of the user exceeds the safety value, or the exercise intensity ES of the user exceeds the safety value (e.g. 95%), the processing unit 150 performs step S1328 to determine a recommended pedaling resistance. Details of the step S1328 may be referred to as the details shown in FIG. 5, FIG. 7 and FIG. 8.

With reference to FIG. 13, in the test mode (step S1320), when the user feels that he or she may not be able to complete the exercise test, the user may inform the processing unit 150 of ending the test mode through a predetermined mechanism (e.g., a button, voice, hand gestures, or the like). After the test mode ends, the processing unit 150 performs step S1330, so as to provide the recommended pedaling resistance (determined in step S1320) to the user for performing the pedaling activity. The way to provide the recommended pedaling resistance in step S1330 may be done by the processing unit 150 which displays the recommended pedaling resistance through the guidance unit 110 for the user's choice. In another exemplary embodiment, the processing unit 150 in step S1330 directly controls the resistance unit to adjust the resistance of the pedaling activity to be the recommended pedaling resistance, so as to provide the recommended pedaling resistance to the user for performing the pedaling activity.

After step S1330 is completed, the processing unit 150 provides the recommended pedaling resistance to the user for performing the pedaling activity when the exercise bike is in the sport mode (step S1340). In the sport mode, the evaluation of sport-related perceived exertion may be conducted instantly according to the user's physical exercise preferences. Besides, in step S1340, the exercise intensity may be dynamically adjusted, the scenario corresponding to the exercise may be displayed, and it is also possible to play the music corresponding to the exercise. Details of the step S1340 may be referred to as the details shown in FIG. 4 and FIG. 9.

Figure 15:
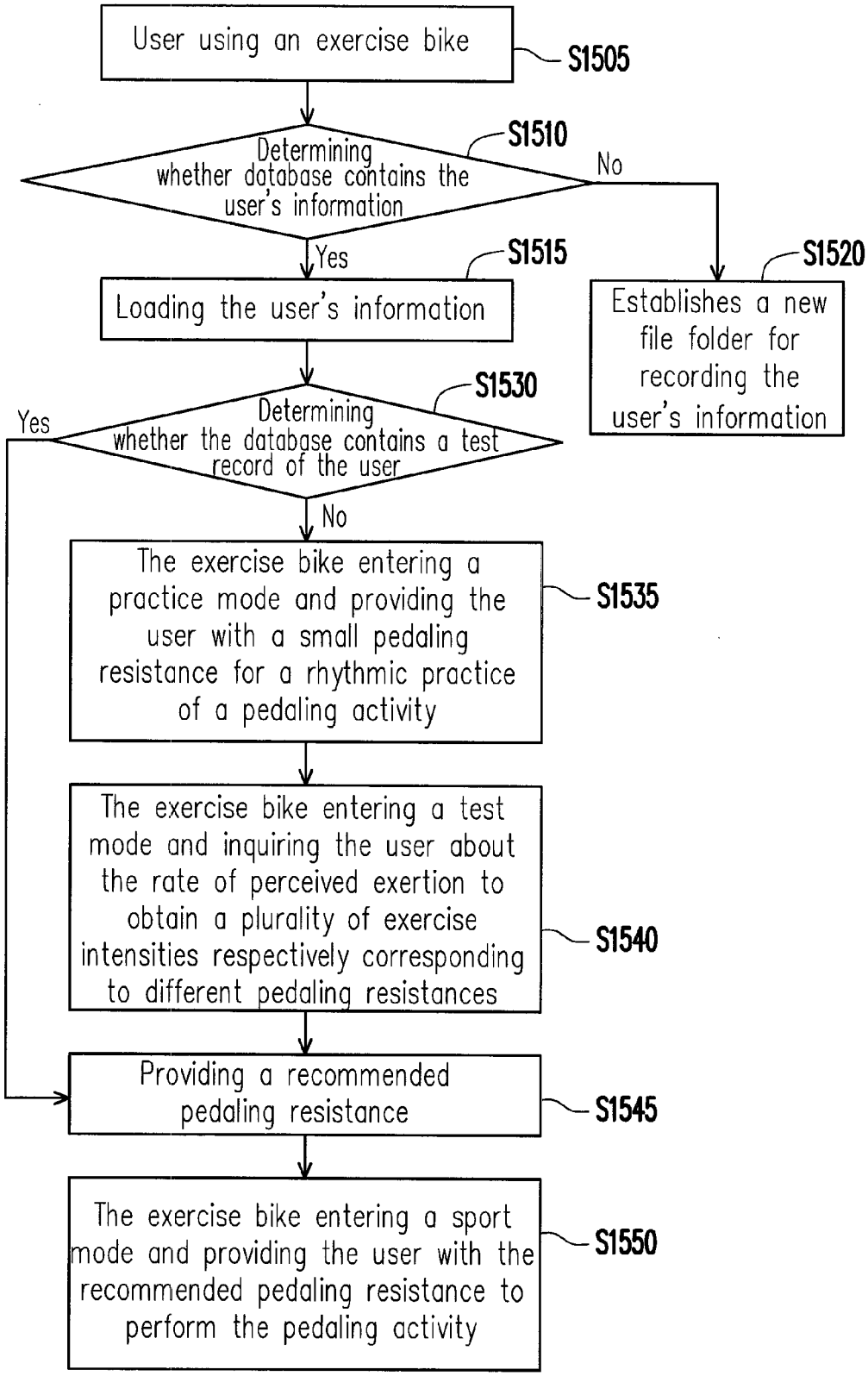
FIG. 15 is a schematic flow chart illustrating an operation method of an exercise bike according to still another exemplary embodiment of the disclosure.

FIG. 15 is a schematic flow chart illustrating an operation method of an exercise bike 100 according to still another exemplary embodiment of the disclosure. Since the details of steps S1505, S1510, S1515, S1520, S1530, and S1535 shown in FIG. 15 may be referred to as the details of steps S1205, S1210, S1215, S1220, S1230, and S1235 depicted in FIG. 12, no further description in this regard is provided hereinafter. The difference between the embodiment shown in FIG. 12 and the embodiment shown in FIG. 15 lies in that the step S1225 is omitted according to the exemplary embodiment shown in FIG. 15. That is, in the present exemplary embodiment, the user is assumed not to use the PMU 140. Since the details of steps S1540, S1545, and S1550 shown in FIG. 15 may be referred to as the details of steps S1320, S1330, and S1340 depicted in FIG. 13, no further description in this regard is provided hereinafter. When the exercise bike is in the sport mode (step S1550), the processing unit 150 through the guidance unit 110 inquires the user about an exercise psychological value RPE of the user. According to the exercise psychological value RPE, the processing unit 150 controls the resistance unit 130 to correspondingly and dynamically adjust the resistance of the pedaling activity. That is, according to the present exemplary embodiment, when the user gets the exercise on the exercise bike 100, the user's psychological values RPE are monitored and timely fed back to the resistance unit 130 of the exercise bike 100 in response to the use condition of the user; thereby, injuries resulting from the exercise may be prevented.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An exercise bike comprising:

a pedaling mechanism, a user performing a pedaling activity through the pedaling mechanism;

a resistance unit connected to the pedaling mechanism, the resistance unit providing and determining a resistance of the pedaling activity;

a guidance unit;

a database; and a processing unit coupled to the database, the resistance unit and the guidance unit, wherein the processing unit controls the resistance unit to adjust the resistance of the pedaling activity to be a plurality of pedaling resistances and inquires the user about a rate of perceived exertion through the guidance unit to obtain a plurality of psychological values respectively corresponding to the pedaling resistances when the exercise bike is in a test mode, the database storing a first correspondence relationship between the plurality of psychological values and a plurality of heart rates of the user, the processing unit respectively converts the plurality of psychological values into the plurality of heart rates according to the first correspondence relationship, the processing unit performs calculation by using the plurality of heart rates to obtain a plurality of exercise intensities respectively corresponding to the pedaling resistances and further obtain a second correspondence relationship between the exercise intensities and the pedaling resistances, and after the test mode ends, the processing unit determines a recommended pedaling resistance according to the second correspondence relationship, so as to provide the recommended pedaling resistance to the user for performing the pedaling activity when the exercise bike is in a sport mode, wherein the processing unit makes the calculation according to an equation ES=(AHR−RHR)/(MHR−RHR), wherein ES is an exercise intensity of the exercise intensities, AHR is an average heart rate of the user, RHR is a resting heart rate of the user, and MHR is an estimated maximum heart rate of the user, wherein before the exercise bike enters the test mode, the processing unit controls the resistance unit to adjust the resistance of the pedaling activity to be a specific pedaling resistance when the exercise bike is in a practice mode, so as to provide the user with a rhythmic practice of the pedaling activity at a rotational speed, wherein after the practice mode ends, the exercise bike enters the test mode after rest if a coefficient of variation of the rotational speed in the practice mode falls within a safety range, and the exercise bike enters the practice mode again if the coefficient of variation of the rotational speed in the practice mode exceeds the safety range.

2. The exercise bike as recited in claim 1, wherein when the exercise bike is in the sport mode, the processing unit controls the resistance unit to adjust the resistance of the pedaling activity to be the recommended pedaling resistance, so as to provide the recommended pedaling resistance to the user for performing the pedaling activity.

3. The exercise bike as recited in claim 1, wherein the guidance unit comprises:

a touch display panel displaying a plurality of perception words and receiving a touch selection of the user, wherein the processing unit generates the plurality of psychological values according to the touch selection.

4. The exercise bike as recited in claim 1, wherein the estimated maximum heart rate of the user is equal to 220-Age, and the Age is the age of the user.

5. The exercise bike as recited in claim 1, wherein the processing unit monitors whether the rotational speed of the exercise bike complies with a practice rotational speed when the exercise bike is in the practice mode, and the processing unit guides the user to maintain the rotational speed of the exercise bike to be the practice rotational speed through the guidance unit.

6. The exercise bike as recited in claim 1, wherein the guidance unit informs the user of a current resistance of the pedaling activity and guides the user to perform the pedaling activity.

7. The exercise bike as recited in claim 1, wherein the database stores basic information of the user and the second correspondence relationship.

8. The exercise bike as recited in claim 1, wherein the resistance unit comprises:

a control unit receiving a resistance command from the processing unit;

a motor driver circuit coupled to the control unit, the motor driver circuit converting the resistance command received by the control unit into a motor driver signal;

a magnetic resistance device coupled to the motor driver circuit, the magnetic resistance device providing and determining the resistance of the pedaling activity of the pedaling mechanism according to the motor driver signal; and a motor resistance position unit coupled between the magnetic resistance device and the control unit, wherein the motor resistance position unit is driven by the magnetic resistance device and rotated, so as to generate a resistance position where the magnetic resistance device is currently located and feed back the resistance position to the control unit.

9. The exercise bike as recited in claim 1, wherein the sport mode comprises a warm-up session, a main exercise session, and a cool-down session.

10. The exercise bike as recited in claim 9, wherein the sport mode further comprises a resting measurement and a recovery measurement, and the processing unit through the guidance unit inquires the user about a pre-exercise psychological value of the user during the resting measurement and inquires the user about a post-exercise psychological value of the user during the recovery measurement.

11. The exercise bike as recited in claim 1, wherein when the exercise bike is in the sport mode, the processing unit inquires the user about an exercise psychological value of the user through the guidance unit, and the processing unit controls the resistance unit to correspondingly and dynamically adjust the resistance of the pedaling activity according to the exercise psychological value.

12. An operation method of an exercise bike, comprising:

performing a pedaling activity by a user through a pedaling mechanism, adjusting a resistance of the pedaling activity to be a plurality of pedaling resistances by a processing unit when the exercise bike is in a test mode;

inquiring a user about a rate of perceived exertion to obtain a plurality of psychological values respectively corresponding to the pedaling resistances when the exercise bike is in the test mode;

providing a database, the database storing a first correspondence relationship between the plurality of psychological values and a plurality of heart rates of the user;

respectively converting the plurality of psychological values into the plurality of heart rates by the processing unit according to the first correspondence relationship;

using the plurality of heart rates to perform calculation by the processing unit, so as to obtain a plurality of exercise intensities respectively corresponding to the pedaling resistances, and further obtain a second correspondence relationship between the exercise intensities and the pedaling resistances;

before the exercise bike enters the test mode, adjusting the resistance of the pedaling activity to be a specific pedaling resistance by the processing unit when the exercise bike is in a practice mode, so as to provide the user with the specific pedaling resistance for a rhythmic practice of the pedaling activity at a rotational speed, wherein after the practice mode ends, the exercise bike enters the test mode after rest if a coefficient of variation of the rotational speed in the practice mode falls within a safety range, and the exercise bike enters the practice mode again if the coefficient of variation of the rotational speed in the practice mode exceeds the safety range;

after the test mode ends, determining a recommended pedaling resistance according to the second correspondence relationship by the processing unit; and providing the recommended pedaling resistance to the user for performing the pedaling activity when the exercise bike is in a sport mode, wherein the step of using the plurality of heart rates to perform calculation comprises:

making a calculation by the processing unit according to an equation ES=(AHR−RHR)/(MHR−RHR), wherein ES is an exercise intensity of the exercise intensities, AHR is an average heart rate of the user, RHR is a resting heart rate of the user, and MHR is an estimated maximum heart rate of the user.

13. The operation method of the exercise bike as recited in claim 12, further comprising:

when the exercise bike is in the sport mode, adjusting the resistance of the pedaling activity to be the recommend pedaling resistance by the processing unit, so as to provide the recommend pedaling resistance to the user for performing the pedaling activity.

14. The operation method of the exercise bike as recited in claim 12, wherein the step of inquiring the user about the rate of perceived exertion comprises:

displaying a plurality of perception words on a touch display panel and receiving a touch selection of the user; and generating the plurality of psychological values by the processing unit according to the touch selection.

15. The operation method of the exercise bike as recited in claim 12, wherein the estimated maximum heart rate of the user is equal to 220—Age, and the Age is the age of the user.

16. The operation method of the exercise bike as recited in claim 12, further comprising:

monitoring whether the rotational speed of the exercise bike complies with a practice rotational speed by the processing unit when the exercise bike is in the practice mode; and guiding the user through the guidance unit to maintain the rotational speed of the exercise bike to be the practice rotational speed.

17. The operation method of the exercise bike as recited in claim 12, further comprising:

informing the user of a current resistance of the pedaling activity; and guiding the user to perform the pedaling activity.

18. The operation method of the exercise bike as recited in claim 12, further comprising:

storing basic information of the user and the second correspondence relationship into the database.

19. The operation method of the exercise bike as recited in claim 12, wherein the sport mode comprises a warm-up session, a main exercise session, and a cool-down session.

20. The operation method of the exercise bike as recited in claim 19, wherein the sport mode further comprises a resting measurement and a recovery measurement, and the operation method further comprises:

inquiring a pre-exercise psychological value of the user during the resting measurement; and inquiring a post-exercise psychological value of the user during the recovery measurement.

21. The operation method of the exercise bike as recited in claim 12, further comprising:

when the exercise bike is in the sport mode, inquiring the user about an exercise psychological value of the user; and correspondingly and dynamically adjusting the resistance of the pedaling activity by the processing unit according to the exercise psychological value.

* * * * *